US007488233B2

(12) United States Patent
Olney

(10) Patent No.: US 7,488,233 B2
(45) Date of Patent: Feb. 10, 2009

(54) MODEL CONVERSION KIT AND METHOD

(76) Inventor: Christopher Tiedmand Olney, 26 Morgan Rd., Richmond, NH (US) 03470

( * ) Notice: Subject to any disclaimer, the term of this patent is extended or adjusted under 35 U.S.C. 154(b) by 298 days.

(21) Appl. No.: 10/943,376

(22) Filed: Sep. 16, 2004

(65) Prior Publication Data

US 2005/0064786 A1 Mar. 24, 2005

Related U.S. Application Data

(60) Provisional application No. 60/504,337, filed on Sep. 19, 2003.

(51) Int. Cl.
*A63H 17/00* (2006.01)

(52) U.S. Cl. ..... 446/462; 446/465; 446/470

(58) Field of Classification Search ..... 446/456, 446/457, 460, 462, 465, 470, 471
See application file for complete search history.

(56) References Cited

U.S. PATENT DOCUMENTS 4,171,592 A 10/1979 Saitoh
4,986,789 A * 1/1991 Hang ..... 446/93
5,248,274 A * 9/1993 Wang ..... 446/6
5,611,691 A 3/1997 Poulain
5,791,967 A * 8/1998 Yeh ..... 446/279
5,893,791 A 4/1999 Wilkinson
6,546,436 B1 4/2003 Fainmesser et al.
6,582,275 B1 * 6/2003 Lai ..... 446/465
6,918,627 B2 * 7/2005 Mataja et al. ..... 296/177

* cited by examiner

*Primary Examiner*—John Ricci
(74) *Attorney, Agent, or Firm*—George W. Dishong

(57) ABSTRACT

A conversion kit and method for converting a non-powered vehicle model to a powered vehicle, in particular, a radio-controlled vehicle is disclosed. The conversion kit can include a chassis plate, a steering assembly having mountable connection to the chassis plate, a rear assembly having mountable connection to the chassis plate, a device for powering the vehicle model, and a device for attaching the chassis plate to a model shell. Also disclosed is a product produced by the conversion kit and/or method of the present invention.

7 Claims, 12 Drawing Sheets

MODEL CONVERSION KIT AND METHOD

CROSS REFERENCE TO RELATED APPLICATIONS

The present application claims priority to U.S. Provisional Application No. 60/504,337 filed Sep. 19, 2003 entitled MODEL CONVERSION KIT AND METHOD which is incorporated herein in its entirety by reference.

BACKGROUND OF THE INVENTION

This invention relates generally to model vehicles, and more specifically to converting a model vehicle to a powered vehicle.

Powered model vehicles, in particular radio-controlled vehicles, typically have little connection with non-powered model vehicles, such as plastic models, particularly with respect to the level of detail usually associated with non-powered model vehicles. In addition, the variety in types of vehicles commercially offered as non-powered model vehicles far exceeds the variety in types of vehicles commercially offered as powered or radio-controlled vehicles. Current products that provide a bridge between powered or radio-controlled vehicles and model vehicles are toy-like in appearance and function. A product is needed in which a non-powered model vehicle may be converted to a powered model vehicle.

Therefore, the object of the present invention is to provide a conversion kit for converting a non-powered model vehicle to a powered model vehicle.

Another object of the present invention is to provide a conversion kit for converting a non-powered model vehicle to a radio-controlled vehicle.

Yet another object of the present invention is to provide a conversion kit, to convert a non-powered model vehicle to a powered or radio-controlled model vehicle, that provides for a finished product that is simple in design, easy to assemble, and has a low cost to manufacture.

A further object of the present invention is to provide a conversion kit that can be adapted to a wide range of currently-available non-powered model vehicles.

A still further object of the present invention is to provide a conversion kit that can result in a powered vehicle that can provide better performance than similarly-sized radio-controlled vehicles.

A yet still further object of the present invention is to provide a conversion kit that can produce a powered vehicle that can be driven in protected or unprotected conditions, at slow speeds or speeds exceeding twenty miles/hour.

A yet still further object of the present invention is to provide an adjustable motor mount that allows adjustments of gear ratios.

A yet still further object of the present invention is to provide an effective full suspension with a simple design.

A yet still further object of the present invention is to provide superior driving control through full ball joint steering with 0°-30° of front pick-up.

A yet still further object of the present invention is to provide a conversion kit that can accommodate many non-powered model vehicle body styles.

A yet still further object of the present invention is to provide a conversion kit that can accommodate various chassis length and width.

A yet still further object of the present invention is to provide a conversion kit that can accommodate for a range of desired non-powered model vehicle uses from classis look to racing speed.

SUMMARY OF THE INVENTION

The objects set forth above as well as further and other objects are achieved by the present invention. The solutions and advantages of the present invention are achieved by the illustrative embodiment described herein below.

The present invention includes a conversion kit for converting a non-powered vehicle model to a powered vehicle, in particular, a radio-controlled vehicle. The conversion kit can include, but is not limited to, a chassis plate, a steering assembly having mountable connection to the chassis plate, a rear assembly having mountable connection to the chassis plate, a means for powering the non-powered vehicle model, and a means for attaching the chassis plate to a model shell of the non-powered vehicle model. Optionally, the present invention can include a means for controlling movement of the powered vehicle.

The present invention also includes a method for converting a non-powered vehicle model that has a vehicle shell to a powered vehicle. The method includes the steps of detaching the vehicle shell from the non-powered vehicle model, attaching a rear assembly onto a chassis plate, attaching a steering assembly onto the chassis plate, attaching a means for powering the non-powered vehicle model onto the chassis plate, and attaching the chassis plate onto the underside of the vehicle shell. Optionally, the method can include the step of attaching a means for controlling the movement of the powered vehicle.

For a better understanding of the present invention, together with other and further objects thereof, reference is made to the accompanying drawings and detailed description. The scope of the present invention is pointed out in the appended claims.

DETAILED DESCRIPTION OF THE INVENTION

The present invention is now described more fully hereinafter with reference to the accompanying drawings, in which the illustrative embodiment of the present invention is shown. The following configuration description is presented for illustrative purposes only. Any non-powered vehicle model may be suitable for use of the conversion kit and method of the present invention, and for producing the powered vehicle of the present invention. In particular, the invention is not limited to automobile models or even to wheeled models, but can be adapted to any model by changing the dimensions of the components of the conversion kit as desired. The dimensions and details that follow are provided for illustrative purposes only and are not to limit the invention to these dimensions and details.

Figure 1:
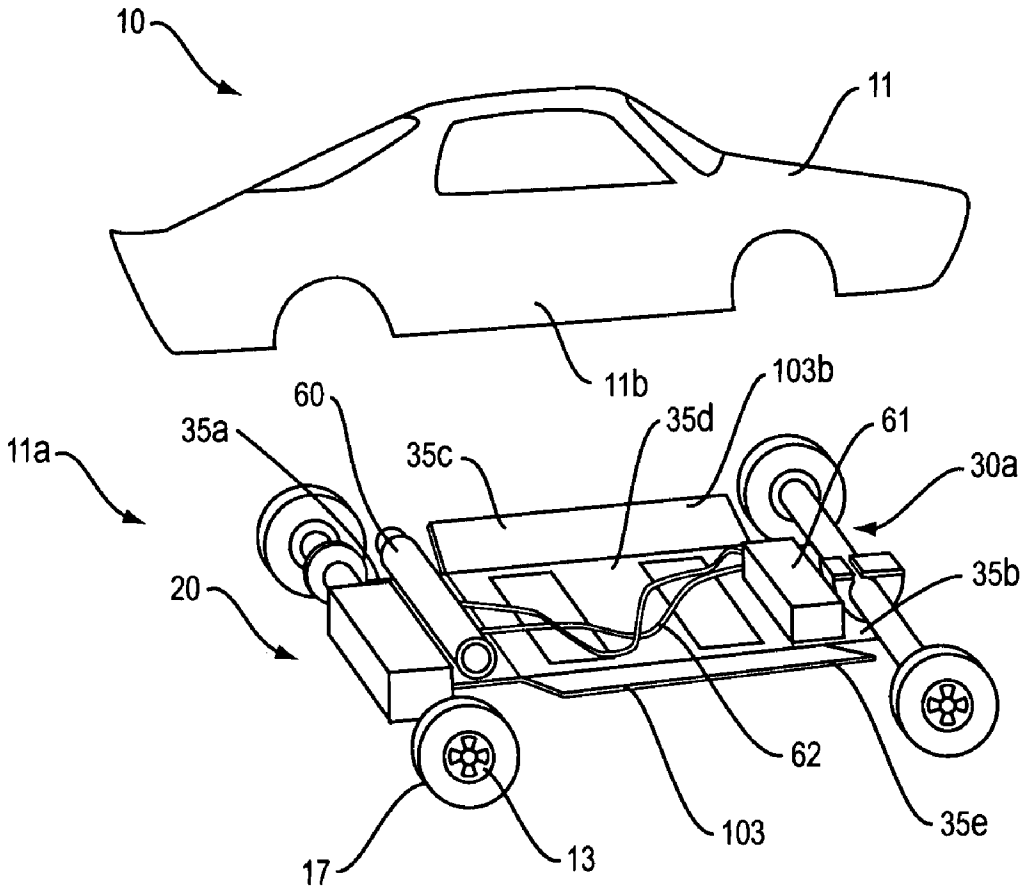
FIG. 1 is a pictorial, schematic view of the major parts of a conversion kit and powered vehicle model of the illustrative embodiment of the present invention.

Referring now to FIG. 1, conversion kit 10A and powered vehicle 10 of the illustrative embodiment of the present invention can include, but are not limited to, conventional vehicle shell 11, chassis plate assembly 11A that provides the housing for the means for powering 60 conventional vehicle shell 11, non-powered vehicle model size-dependent chassis plate 35, steering assembly 30A, rear assembly 20, means for powering 60 the non-powered vehicle model 110B such as, for example, conventional motor, made by, for example, GWS®, and means for attaching chassis plate 35 to conventional vehicle shell 11 such as first adhering surface 103 and second adhering surface 103B, for example VELCRO® strips. Model vehicle kits, such as those supplied by REVELL®, AMT®, and ERTL®, contain conventional vehicle shell 11 and conventional rims/hubcaps 13. Conversion kit 10A may optionally include a means for controlling 61 the powered vehicle 10 such as, for example a CIRRUS® CS-10BB, having electrical connection 62 with means for powering 60. Note that throughout the following discussion, various types of conventional screws that are described are available from suppliers such as, for example, DU-BRO®, RR ROBINSON RACING®, and TEAM LOSI®. Screw sizes can vary depending on the size of the model. For a 1/24 or 1/25 scale model, screws, ball joints, nuts, and threaded rods are generally 2-56 in various lengths, while set screws and some threaded rods are 4-40 in various lengths. The invention is not limited to these specifications, types and sizes of screws, or manufacturers.

Continuing to primarily refer to FIG. 1, powered vehicle 10 of the present invention is prepared according to the steps of the method of the present invention which include, but are not limited to, detaching conventional vehicle shell 11 from non-powered vehicle model 10B, attaching rear assembly 20 (FIG. 2) to rear wheel assembly mount 35A (FIG. 5), attaching steering assembly 30A (FIG. 1) to steering assembly mount 35B (FIG. 5), attaching means for powering 60 non-powered vehicle model 10B such as, for example, conventional motor, to chassis plate 35 (FIG. 5), and attaching chassis plate 35 onto underside 11B of conventional vehicle shell 11.

Figure 2:
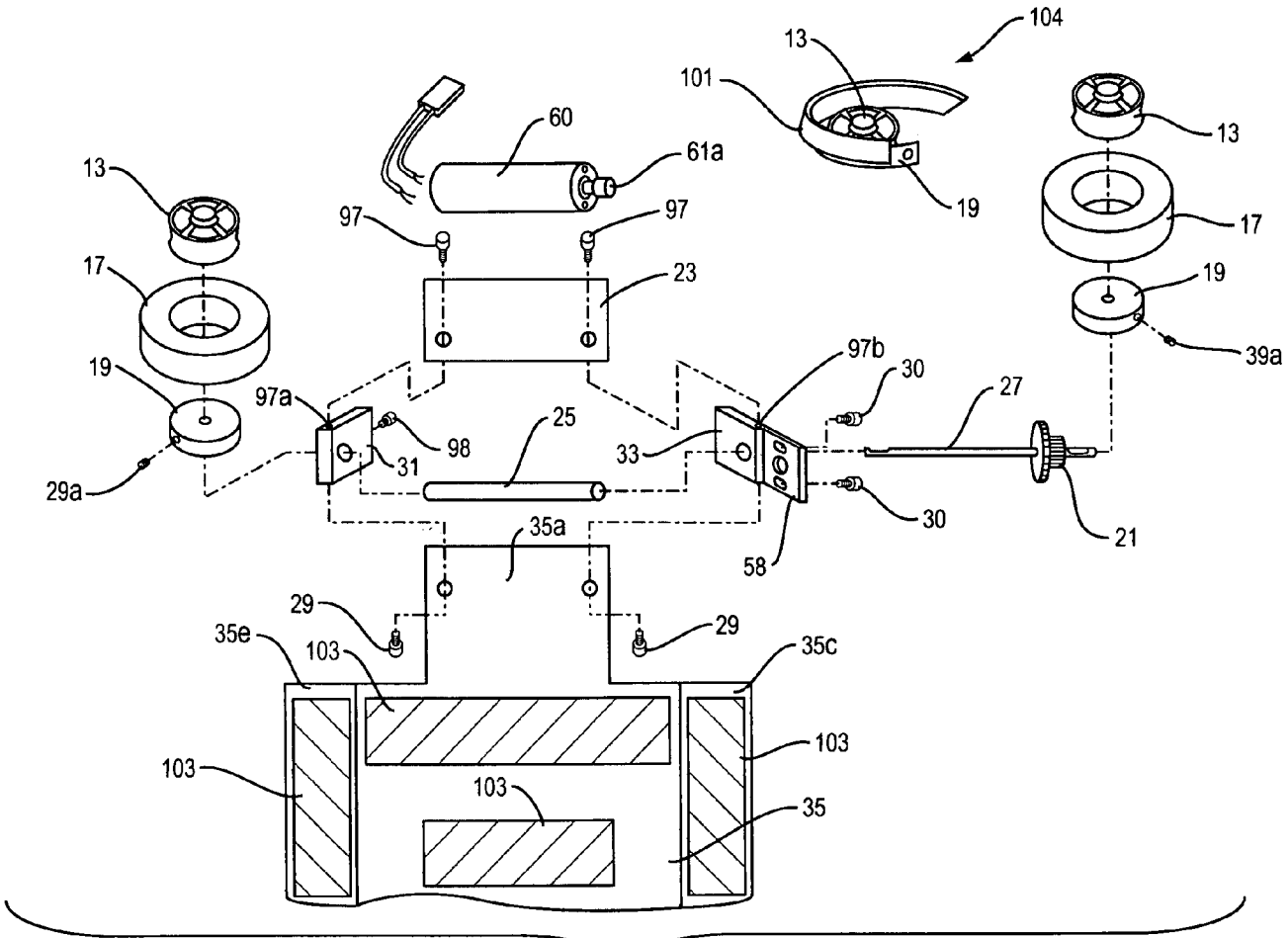
FIG. 2 is a pictorial view of rear assembly parts of the conversion kit and a method of rear assembly construction of the illustrative embodiment of the present invention.

Referring now primarily to FIG. 2, the parts required for and method of rear assembly 20 of the illustrative embodiment of the present invention are shown. For example, the method can include, but is not limited to, the steps of sliding tube 25, made of, for example, brass, and available from, for example, K+S®, into right rear bulkhead 31 (FIG. 9) and securing it with tube screw 98. The method can also include the steps of sliding left rear bulkhead 33 (FIG. 10) onto the other sides of tube 25, securing rear upper plate 23 (FIG. 12) to right rear bulkhead 31 at right bulkhead recess 97A, and securing left rear bulkhead 33 at left bulkhead recess 97B with bulkhead screws 97. The method can further include the steps of securing this completed assembly to rear wheel assembly mount 35A (FIG. 5) with rear chassis screws 29, sliding spur gear 21, available, for example, from JR®, onto shaft 27, available, for example, from Du-Bro®, made of, for example, steel, and sliding the assembly is slid into tube 25.

Continuing to refer primarily to FIG. 2, the method can still further include the steps of securing the means for powering 60, such as, for example, conventional motor, to left bulkhead inner side 58 (FIG. 10) with motor screws 30, and joining conventional rims/hubcap 13 and wheel 19 (FIG. 11), for example, by conventional double-sided tape 101 that is wrapped around the outer circumference of conventional rims/hubcap 13 and wheel 19. The method can still further include the steps of placing tire 17, available, for example, from ABC Hobby, around conventional rims/hubcap 13 and wheel 19, securing tire 17 in place by conventional double-sided tape 101 forming tire assembly 104, and attaching tire assembly 104 to shaft 27 by inserting wheel screw 29A, for example a set screw, in wheel 19. This procedure is followed for both rear tires. The method can still further include the steps of adjusting the alignment of tires 17 and shaft 27 by loosening tube screw 98, moving brass tube 25, and retightening tube screw 98, and when tires 17 are evenly spaced with respect to the center of chassis plate 35, gluing spur gear 21 to shaft 27 with a self-penetrating glue such as, for example, thin Cyanoacrylate.

Figure 3:
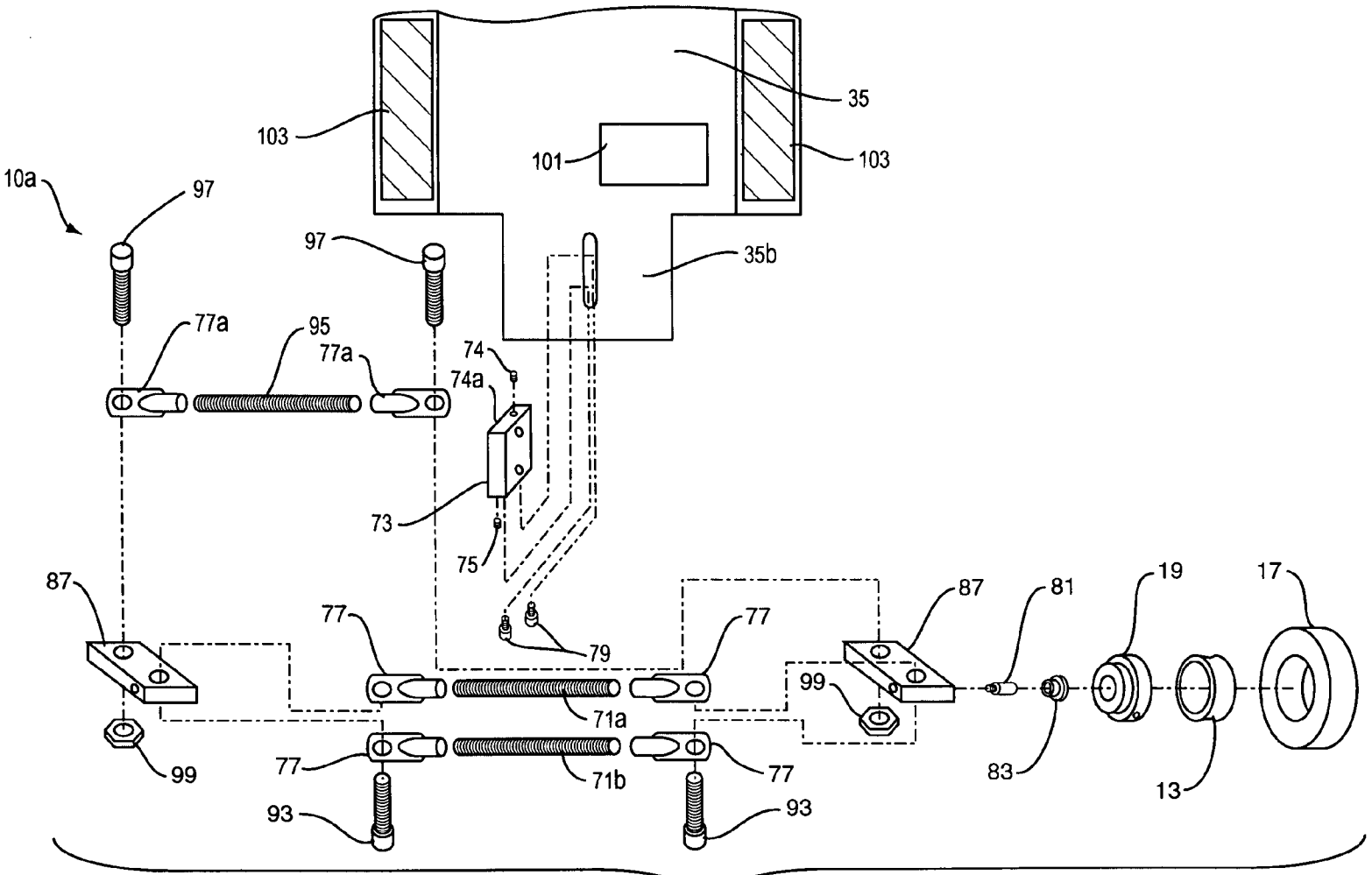
FIG. 3 is a pictorial view of front assembly parts of the conversion kit and the method of steering assembly construction of the illustrative embodiment of the present invention.

Referring now primarily to FIG. 3, the parts required and method of construction steering assembly 30A (FIG. 1) of the illustrative embodiment of the present invention are shown. The method of construction can include the steps of threading steering rods 71A and 71B, made from, for example, steel, through and centering them in front bulkhead 73 (FIG. 7), and securing steering rods 71A and 71B in front bulkhead 73 by top rod screw 74 and bottom rod screw 75, such as, for example, a set screw. The method can further include the steps of threading steering rods 71A and 71B onto lower ball joints 77, available from, for example, DU-BRO®, to form an assembly, and securing the assembly to steering assembly mount 35B (FIG. 6) with front screws 79, for example round-head screws. The method can still further include the steps of pressing axle 81, made of, for example, brass, available from, for example DU-BRO®, into ball bearing 83, available, for example, from Dynamite, to form an assembly, and gluing the assembly into wheel 19 from the non-powered vehicle model 10B. The method can still further include the steps of securing axle 81 in first and second steering arms 87A and 87B (FIG. 8) with conventional liquid thread lock, and connecting conventional rims/hubcap 13, wheel 19, and tire 17 as described above.

Continuing to refer to FIG. 3, the method can still further include the steps of inserting screws 93 into lower ball joints 77 and upper ball joints 77A and first and second steering arms 87A and 87B as shown, threading upper threaded rod 95 into upper ball joints 77A as described above, to form an assembly, and securing the assembly to first and second steering arms 87A and 87B with bulkhead screws 97 that pass through lower ball joints 77 and upper ball joints 77A, and ultimately through nuts 99.

Figure 4:
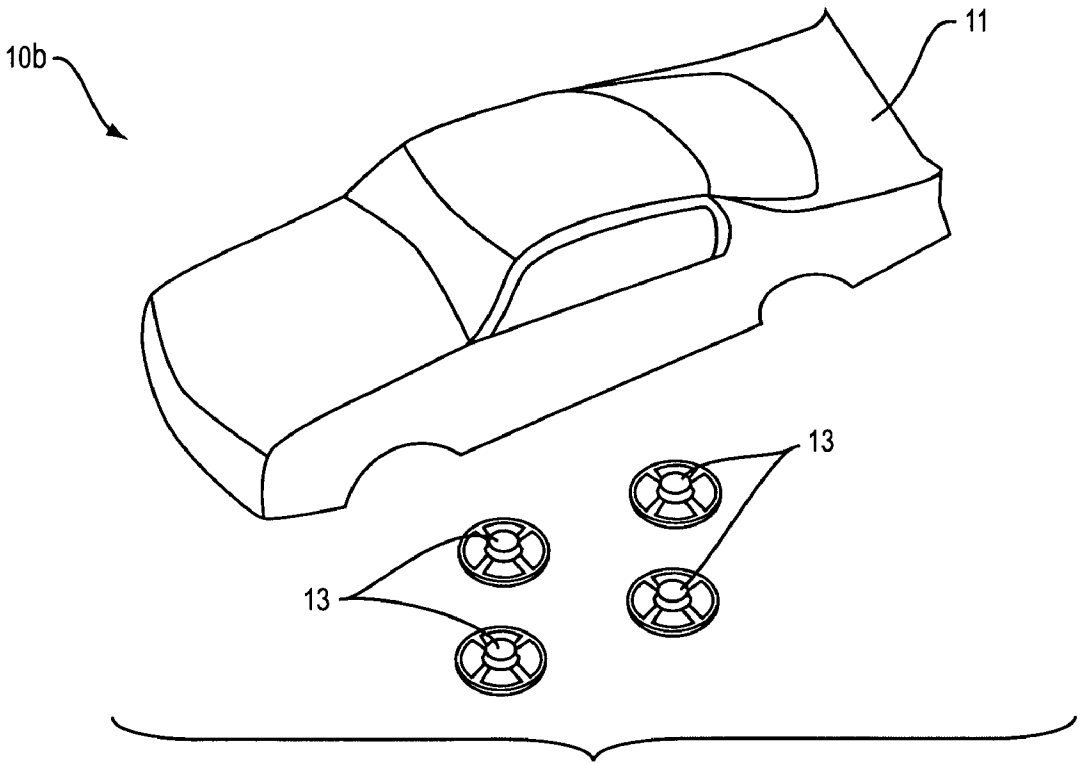
FIG. 4 is a pictorial view of the parts of a non-powered vehicle model that are used along with the conversion kit to create the powered vehicle of the illustrative embodiment of the present invention.

Referring now primarily to FIG. 4, the parts of a non-powered vehicle model 10B that can be used for completing the powered vehicle 10 of the illustrative embodiment of the present invention are shown. In particular, conventional vehicle shell 11 is mounted atop chassis plate 35 (FIG. 1) that has been fitted with the inner workings required to convert a non-powered model vehicle 10B to a powered vehicle 10. Conventional rims/hubcaps 13 can also be used to create the same style in a powered vehicle 10 that is provided in the non-powered model vehicle 10B.

Figure 5:
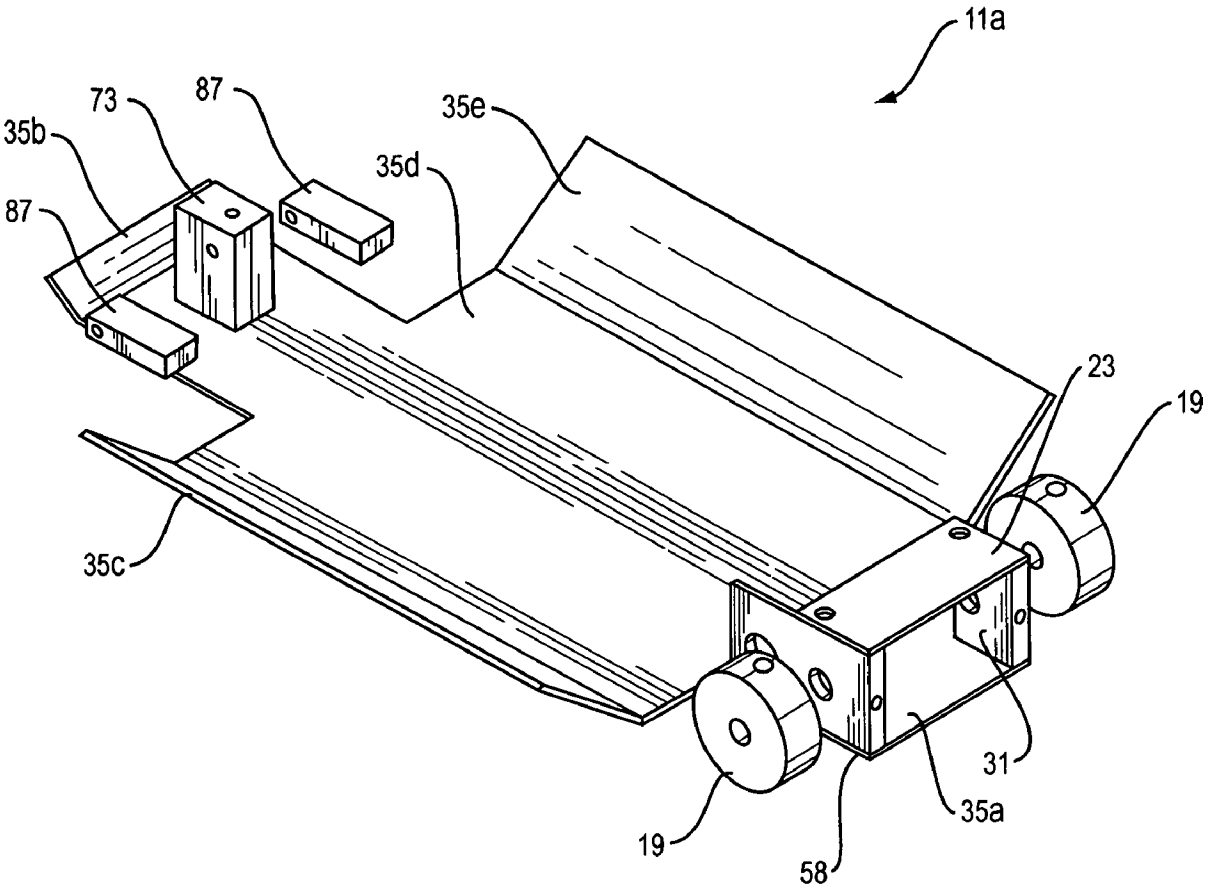
FIG. 5 is a schematic diagram of a chassis assembly of the illustrative embodiment of the present invention.
Figure 6A:
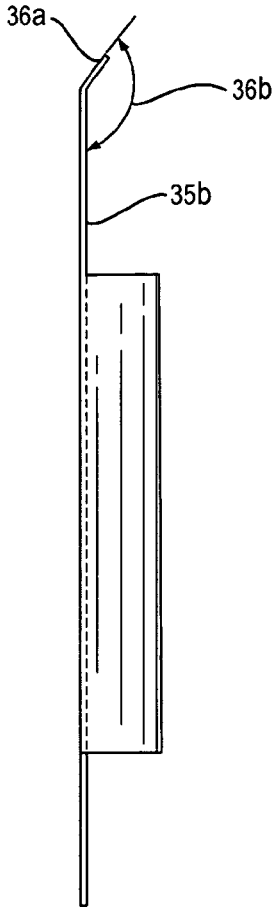
FIG. 6 is a schematic diagram of a chassis plate of the illustrative embodiment of the present invention.
Figure 6B:
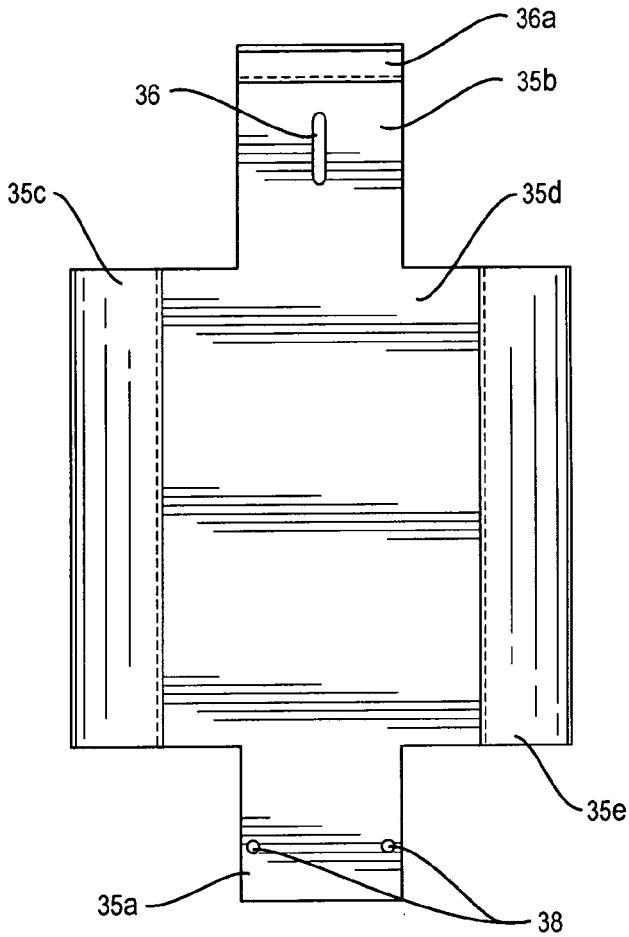
Figure 6C:
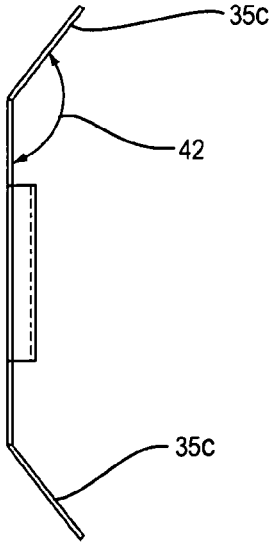
Figure 6D:
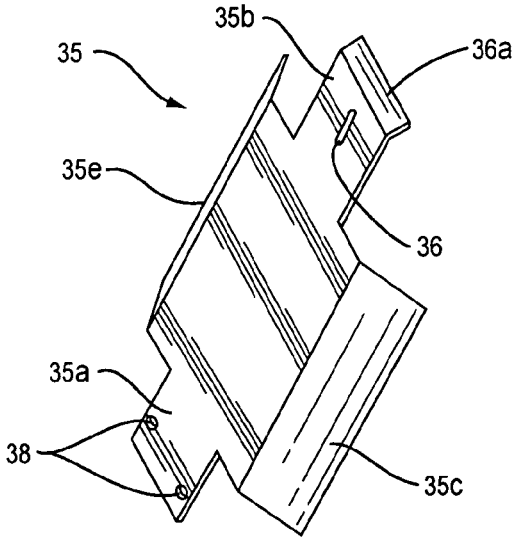

Referring now primarily to FIG. 5, a schematic diagram of the chassis assembly is shown. The chassis assembly includes chassis plate 35, right chassis plate wing 35E, left chassis plate wing 35C, steering assembly mount 35B, and rear wheel assembly mount 35A. Upon steering assembly mount 35B are mounted, among other things, front bulkhead 73 and first and second steering arms 87A and 87B according to the method described in FIG. 3. Upon rear wheel assembly mount 35A are mounted left bulkhead inner side 58 and right rear bulkhead 31, upon which are mounted rear upper plate 23, and to which are mounted wheel 19, according to the method shown in FIG. 2.

Referring now primarily to FIG. 6, details of chassis plate 35 of the illustrative embodiment of the present invention are shown. Chassis plate 35 is dimensioned illustratively for a wide range of currently available 1/24 and 1/25 scale models. The invention is not limited to these dimensions, which are provided for illustrative purposes only. Nor is the invention limited to 1/24 and 1/25 scale models, but can obviously be up- or down-sized depending on the size and shape of the non-powered vehicle model 10B of the user's choice. Center chassis plate 35D, right and left chassis plate wings 35E and 35C, steering assembly mount 35B and rear wheel assembly mount 35A can be formed of continuous material such as, for example, plastic, or can be provided as separate parts that are made to adhere to each other either fixedly or removably. Steering assembly mount 35B can include, but is not limited to, front chassis wing 36A and front attachment recess 36, which may be any shape and size, or may be multiple recesses, so long as they accommodate the mounting of steering assembly 30A (FIG. 1). Front chassis wing 36A forms front angle 36B with steering assembly mount 35B. Right and left chassis plate wings 35E and 35C form center angle 42 with center chassis plate 35D. Both front angle 36B and center angle 42 are preferably 140°, but the invention is not limited to that angle. Rear wheel assembly mount 35A preferably includes two mounting recesses 38, but can include any number and shape of mounting recesses 38 to accommodate the mounting of rear assembly 20 (FIG. 1).

Figure 7A:
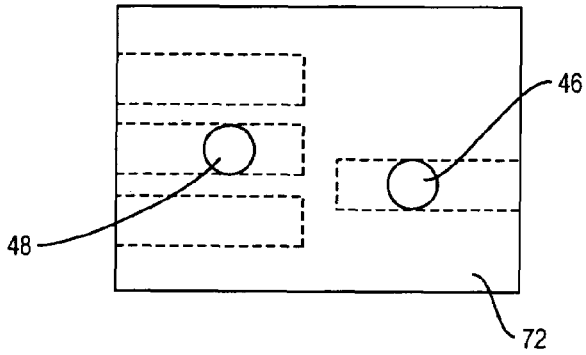
FIG. 7 is a schematic diagram of a front bulkhead of the illustrative embodiment of the present invention.
Figure 7B:
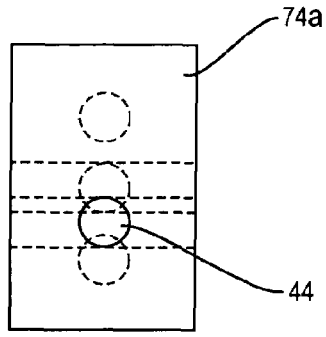
Figure 7C:
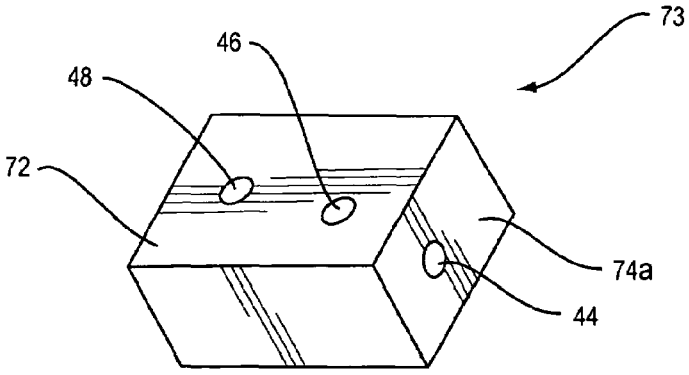

Referring now to FIG. 7, illustrative dimensions are shown for front bulkhead 73. Front bulkhead 73 is not limited to these dimensions nor this size and shape. Relative positioning of steering rods 71A and 71B accommodate mounting on steering assembly mount 35B. Front bulkhead face 72 can include, but isn't limited to, first threaded rod recess 48 (that extends through the depth of front bulkhead 73) to accommodate steering rod 71A and second threaded rod recess 46 (that also extends through the depth of front bulkhead 73) to accommodate steering rod 71B. Front bulkhead top 74A includes rod position recess 44 to accommodate rod screw 74.

Figure 8A:
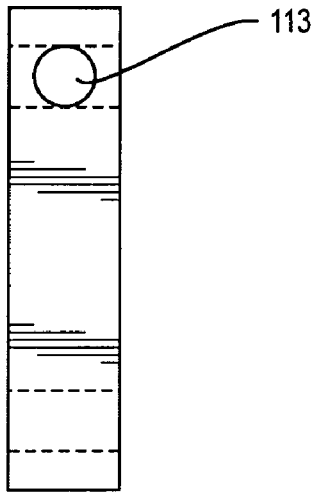
FIG. 8 is a schematic diagram of first and second steering arms of the illustrative embodiment of the present invention.
Figure 8B:
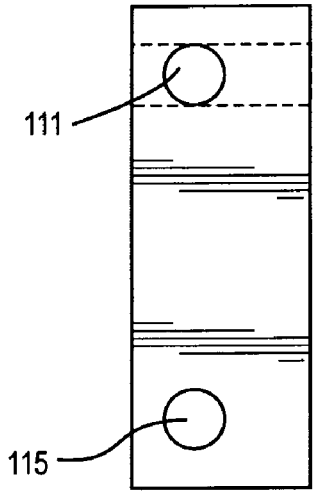
Figure 8C:
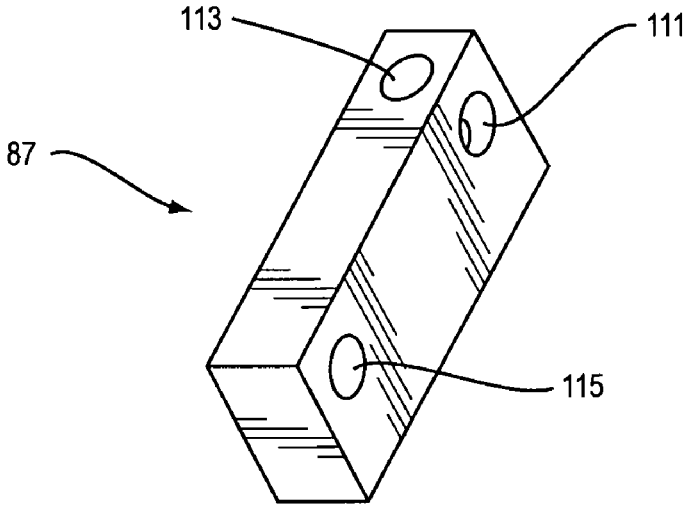
Figure 9A:
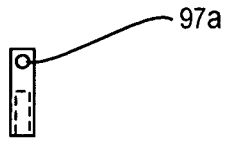
FIG. 9 is a schematic diagram of a right rear bulkhead of the illustrative embodiment of the present invention.
Figure 9B:
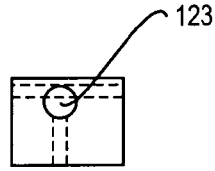
Figure 9C:
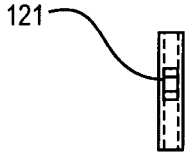
Figure 9D:
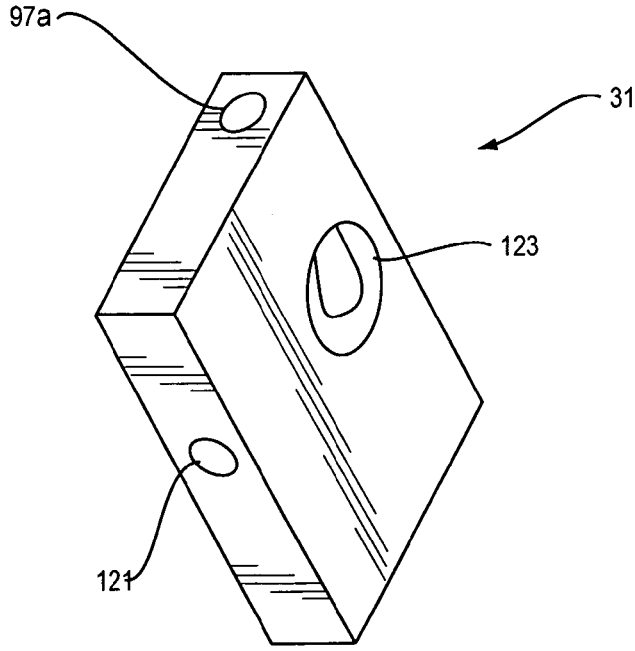

Referring now primarily to FIG. 8, first and second steering arms 87A and 87B are shown in detail. In particular, lower steering rods 71A and 71B (FIG. 3) are mounted around lower rod recess 111, while upper threaded rod 95 (FIG. 3) is mounted at upper recess 115. Axle 81 (FIG. 3) is positioned in axle recess 113.

Referring now primarily to FIG. 9, right rear bulkhead 31 is shown in detail. In particular, tube 25 (FIG. 2) is positioned within right tube recess 123. Bulkhead screw 97 (FIG. 2) is fitted into right bulkhead recess 97A, and retightening tube screw 98 (FIG. 2) is fitted into retightening recess 121 for maintaining the position of tube 25.

Figure 10A:
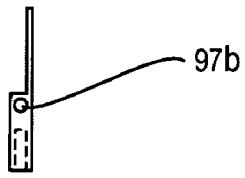
FIG. 10 is a schematic diagram of a left rear bulkhead of the illustrative embodiment of the present invention.
Figure 10B:
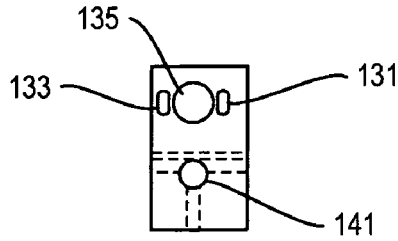
Figure 10C:
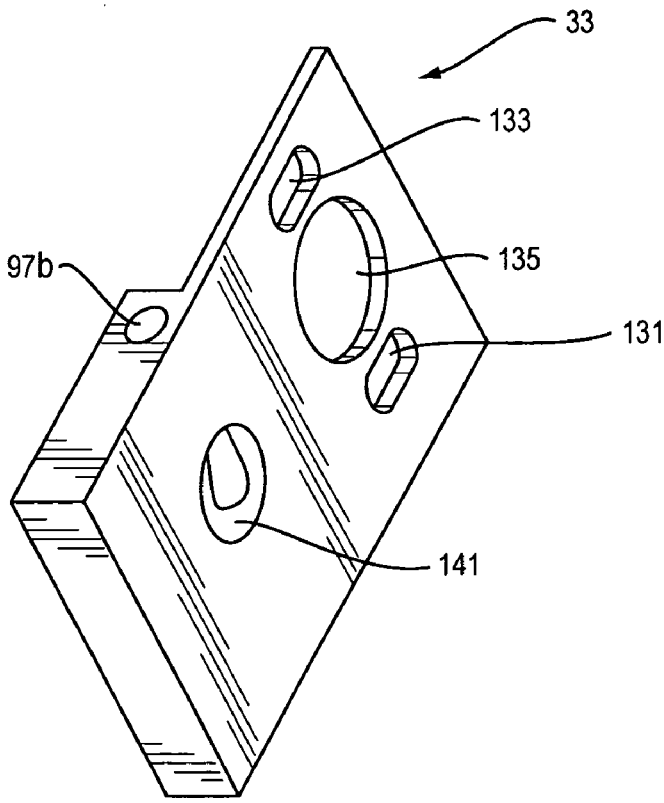
Figure 11A:
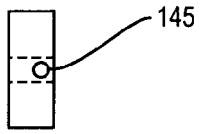
FIG. 11 is a schematic diagram of a rear wheel of the illustrative embodiment of the present invention.
Figure 11B:
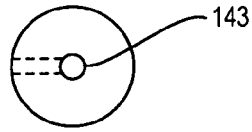
Figure 11C:
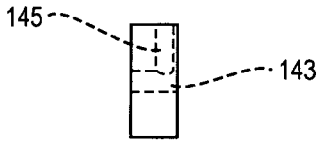
Figure 11D:
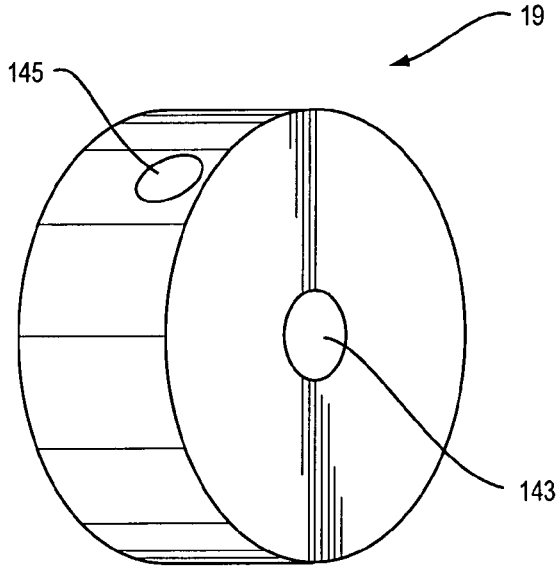

Referring now primarily to FIG. 10, left rear bulkhead 33 is shown in detail. In particular, motor screws 30 (FIG. 2) mount means for powering 60 (FIG. 2) onto left bulkhead inner side 58 (FIG. 2) in upper and lower mount recesses 131 and 133, and motor gear 60A (FIG. 2) is fitted into motor mount recess 135. Bulkhead screw 97 (FIG. 2) is fitted into left bulkhead recess 97B, and tube 25 (FIG. 2) is positioned within left tube recess 141.

Referring now primarily to FIG. 11, rear wheel 19 is shown in detail. In particular, shaft 27 (FIG. 2) is positioned through shaft recess 143, and wheel screw 29A (FIG. 2) and wheel recess 145 hold wheel 19 in position.

Figure 12A:
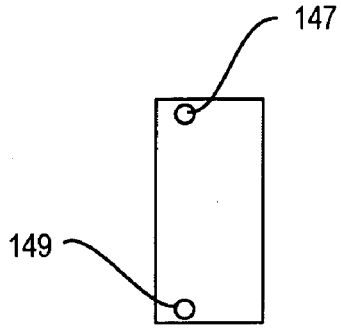
FIG. 12 is a schematic diagram of a rear upper plate of the illustrative embodiment of the present invention.
Figure 12B:
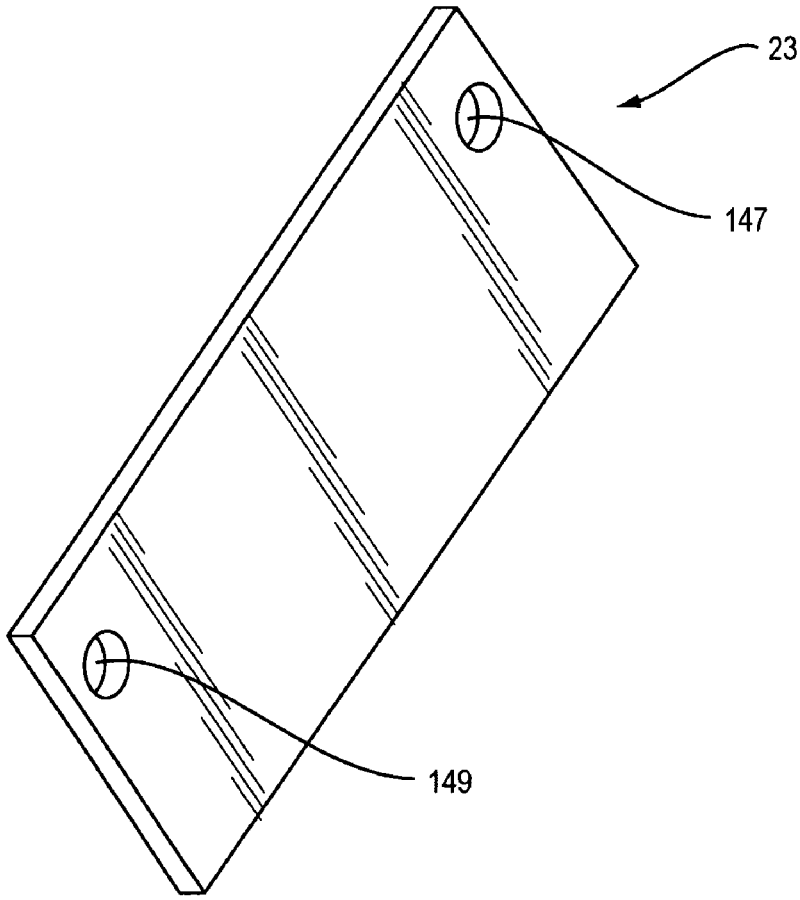

Referring now primarily to FIG. 12, rear upper plate 23 is shown in detail. In particular, left mounting recess 147 and right mounting recess 149 retain rear upper plate 23 in position above tube 25 (FIG. 2) through bulkhead screws 97 (FIG. 2) that are fitted into right bulkhead recess 97A and left bulkhead recess 97B.

FIGS. 5-12 present illustrative measurements that can be useful in constructing the powered vehicle 10 of the present invention. The present disclosure does not preclude a conversion kit that may be constructed of parts having different sizes from the sizes in FIGS. 5-12, and/or with some parts combined and/or eliminated entirely. The present invention is not limited to the measurements provided, nor to the exact parts disclosed. Nor is the invention limited to the exact method of construction of the powered vehicle 10 using the conversion kit of the present invention.

Although the invention has been described with respect to various embodiments, it should be realized that this invention is also capable of a wide variety of further and other embodiments within the spirit and scope of the appended claims.

What is claimed is:

1. A conversion kit for converting a non-powered vehicle model to a powered vehicle comprising:

a chassis plate;

a steering assembly having mountable connection to said chassis plate;

a rear assembly having mountable connection to said chassis plate;

means for powering the non-powered vehicle model having a mountable connection to said chassis plate; and means for attaching said chassis plate to a vehicle shell of the non-powered vehicle model, said vehicle shell having an underside wherein said chassis plate further comprises;

a center chassis plate sized substantially to fit within said underside;

a steering assembly mount having connection to a first edge of said center chassis plate, said steering assembly mount being capable of attachment to said steering assembly; and a rear wheel assembly mount having connection to a second edge of said center chassis plate, said rear wheel assembly mount being capable of attachment to said rear assembly.

2. The conversion kit as defined in claim 1 wherein said means for attaching further comprises:

a right chassis plate wing having connection to a third edge of said center chassis plate, said right chassis plate wing having a first adhering surface, said first adhering surface attaching to said vehicle shell; and a left chassis plate wing having connection to a fourth edge of said center chassis plate, said left chassis plate wing having a second adhering surface, said second adhering surface attaching to said vehicle shell.

3. The conversion kit as defined in claim 2 wherein said first adhering surface is of hook and loop form.

4. The conversion kit as defined in claim 2 wherein said first adhering surface is glue.

5. The conversion kit as defined in claim 2 wherein said first adhering surface is snaps.

6. The conversion kit as defined in claim 2 wherein said second adhering surface is selected from the group consisting of hook and loop form, glue, and snaps.

7. A conversion kit for converting a non-powered vehicle model to a powered vehicle comprising:

a chassis plate;

a steering assembly having mountable connection to said chassis plate;

a rear assembly having mountable connection to said chassis plate;

means for powering the non-powered vehicle model having a mountable connection to said chassis plate; and means for attaching said chassis plate to a vehicle shell of the non-powered vehicle model, said vehicle shell having an underside wherein said steering assembly further comprises:

at least one steering rod having a right end and a left end;

a front bulkhead having mounting connection with said at least one steering rod, said means for controlling being matingly attached to said front bulkhead, said means for controlling having electrical connection with said means for powering the powered vehicle;

a first steering arm matingly attached to said right end, said first steering arm having means for mounting a wheel; and a second steering arm matingly attached to said left end, said second steering arm having means for mounting a wheel.

* * * * *